US007665160B1

(12) United States Patent
Linder

(10) Patent No.: US 7,665,160 B1
(45) Date of Patent: Feb. 23, 2010

(54) METHOD AND APPARATUS FOR RESTORING ONE-PIECE CULTURED MARBLE COUNTERTOP SINKS

(76) Inventor: Brent Linder, 17180 Hwy. 431, Prairieville, LA (US) 70769

( * ) Notice: Subject to any disclaimer, the term of this patent is extended or adjusted under 35 U.S.C. 154(b) by 275 days.

(21) Appl. No.: 11/704,815

(22) Filed: Feb. 9, 2007

(51) Int. Cl.
*A47K 1/04* (2006.01)

(52) U.S. Cl. ..... 4/650; 4/679; 285/208; 285/214; 285/338; 403/297; 411/55

(58) Field of Classification Search ..... 4/255.08, 4/288, 650, 661, 679; 285/59, 60, 139.3, 285/208, 214, 216, 338, 346, 357; 403/297; 411/55

See application file for complete search history.

(56) References Cited

U.S. PATENT DOCUMENTS 2,019,642 A 11/1935 Alley
2,132,636 A * 10/1938 Maahs ..... 285/208
2,635,252 A 4/1953 Gerue et al.
3,045,254 A 7/1962 Cook et al.
4,043,853 A 8/1977 Saladino
4,158,585 A 6/1979 Wright
4,602,393 A 7/1986 Fiveash
D337,378 S 7/1993 Mele
5,650,228 A 7/1997 May
5,661,857 A 9/1997 McLean
6,017,462 A 1/2000 Rains

* cited by examiner

*Primary Examiner*—Robert M Fetsuga
(74) *Attorney, Agent, or Firm*—Robert N. Montgomery

(57) ABSTRACT

A permanent restoration of one-piece cultured marble bathroom countertop/sinks including the insertion of a polymeric bowl within the existing sink without the need to remove or replace existing plumbing. The polymeric bowl insert is secured in place over the existing sink with an expandable drain insert. Seals and adaptive deformable strips, attached to the outer surface of the bowl, provide support and insure a snug and watertight fit within an existing cultured marble countertop/sink.

8 Claims, 5 Drawing Sheets

METHOD AND APPARATUS FOR RESTORING ONE-PIECE CULTURED MARBLE COUNTERTOP SINKS

1. FIELD OF THE INVENTION

This invention relates generally to sink or tub liners and more particularly to the permanent restoration of one-piece cultured marble bathroom countertop/sinks by the insertion of a polymeric bowl within the existing sink without the need to remove or replace existing plumbing. The polymeric bowl insert is secured in place over the existing sink with an expandable drain insert.

2. GENERAL BACKGROUND

Cultured marble, a chemically formulated polymeric so named because of its marbled appearance, is quite common in new home construction and in remodeled older homes, hotels, and motels for vanity tops, bathtubs or shower wall coverings throughout the country. Countertops or vanity top fixtures are commonly described as being one solid piece, with the counter top and sink bowl molded as one. Such countertops may be used as a top for bathroom cabinets or designed simply as a one-piece countertop with one or more basins or sinks.

Over the years crazing or cracks often appear in cultured marble countertop sinks, typically at the drain area, which leads to the possibility of leaks and bacteria and mold growth. Cultured marble can easily become scratched, abused by abrasive cleansers, sharp objects or can be burned by cigarettes, curling irons or candles. The sink bowls also tend to developed moderate to large cracks around the drain area or staining may be present on the surface areas of the sink or countertop around the sink. These unsightly problems are frequent in hotels and motels where room traffic is high. Especially In commercial applications such as hotels and motels, it is essential that bathroom sinks and baths be maintained in a clean, attractive and hygienic condition in order to maintain the highest ratings.

When one of these cultured marble vanity tops or sinks is in need of repair, restoration in some cases by professional refinishers can be completed in as little as an hour. Some damage such as burns, stains and scratches can be bulled or sanded out and a durable polymer clear coat applied after repairs are completed. Other damages like cracks in the sink bowl are much more difficult to repair since only solid colors are available and the swirls in cultured marble cannot be duplicated. Therefore, if restoration becomes obvious and appearance is a concern, recoating or replacement of the entire fixture may be the only solution. In any case, refinishing or repairing cultured marble countertop sink combinations is a lot cheaper then replacing it, especially if you have a custom-sized countertop. However, there is no warranty with such restoration repairs. Such repairs are more easily chipped and/or stained thus requiring additional repairs.

Recoating the cultured marble counter top, although possible and less expensive than replacement, is still relatively expensive, quite messy, and requires days to prepare and complete. For hotels and motels, taking the rooms out of service for such periods of time adds to the cost.

In many cases the cultured marble countertops and sink bowls can no longer be repaired in which case the only options are to replace the entire countertop and sink or cut out the sink bowl and replace with a drop-in bowl. The latter, although less expensive than countertop replacement, requires precise measuring and cutting of the cultured marble countertop and the removal of the plumbing faucets, drains etc. Removal and replacement of the existing plumbing is an expensive process and even more so when old pipes are disturbed, often causing even more extensive plumbing repairs. Such unexpected restoration cost often drives the repairs beyond the cost of replacing the whole counter/sink combination.

Although the prior art teaches the possibility of utilizing wash basin inserts, usually in the form of temporary or disposable liners, vacuum formed plastic sheets and ceramic tub and shower overlays, there has been little progress towards a fast and inexpensive permanent restoration for cultured marble countertop/sinks. The instant invention satisfies the need by providing a permanent drop-in sink liner for cultured marble countertop/sinks that can be installed in an hour without removing or replacing the existing sink or plumbing.

3. SUMMARY OF THE INVENTION

At least one aspect of the invention is a polymeric sink insert for cultured marble countertop/sinks. The pre-molded or otherwise configured sink or wash bowl insert, generally conforming to the contours of the existing marble countertop/sink being restored, includes a drain opening at the bottom of the bowl and an eccentric horizontal flange surrounding the bowl in a manner that does not interfere with existing faucets. A drain insert is also provided for transitioning from the bowl insert to the existing sink drain, which can be installed without removing the existing drain. Seals and adaptive foam strips are attached to the outer surface of the bowl to provide support and insure a snug and watertight fit within an existing cultured marble countertop/sink.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
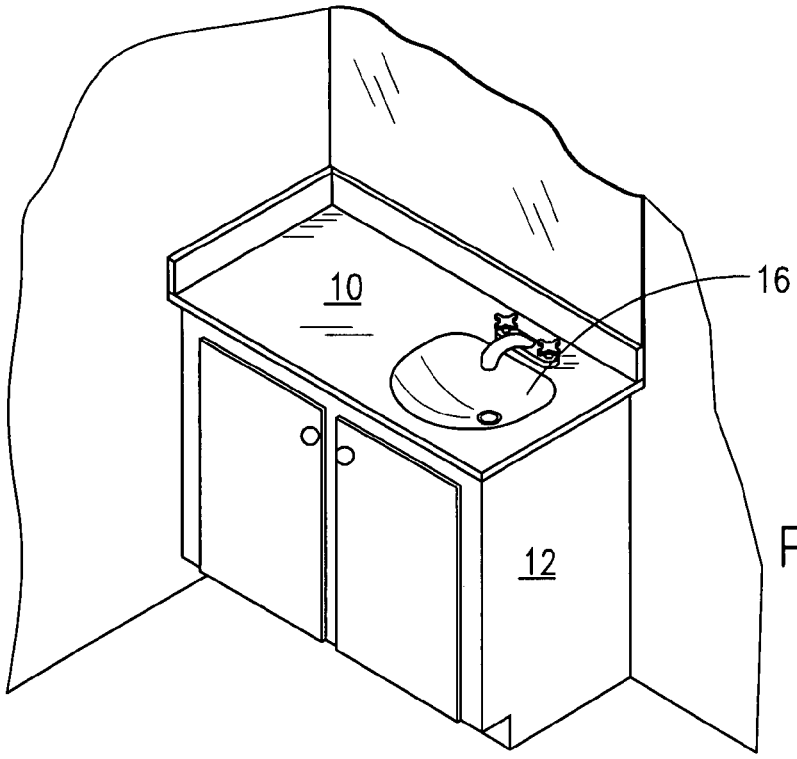
Fig. 1 PRIOR ART
FIG. 1 is a partial isometric view of a prior art under cabinet style cultured marble countertop/sink.
Figure 2:
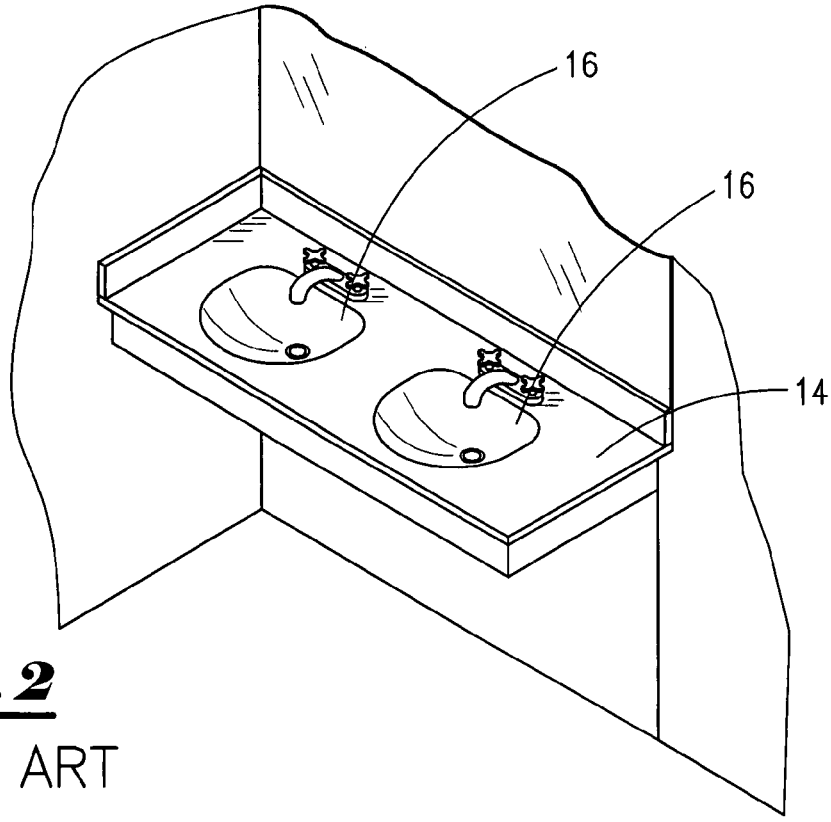
Fig. 2 PRIOR ART
FIG. 2 is a partial isometric view of a prior art cultured marble, countertop/sink.

As may be seen in FIG. 1, the prior art utilizes cultured marble countertop/sink or vanity tops 10 molded in one solid piece. Such countertops 10 are generally used as a top for bathroom cabinets 12 or designed simply as a one-piece countertop 14 with one or more basins or sinks 16, as shown in FIG. 2, for use without cabinets.

Figure 3:
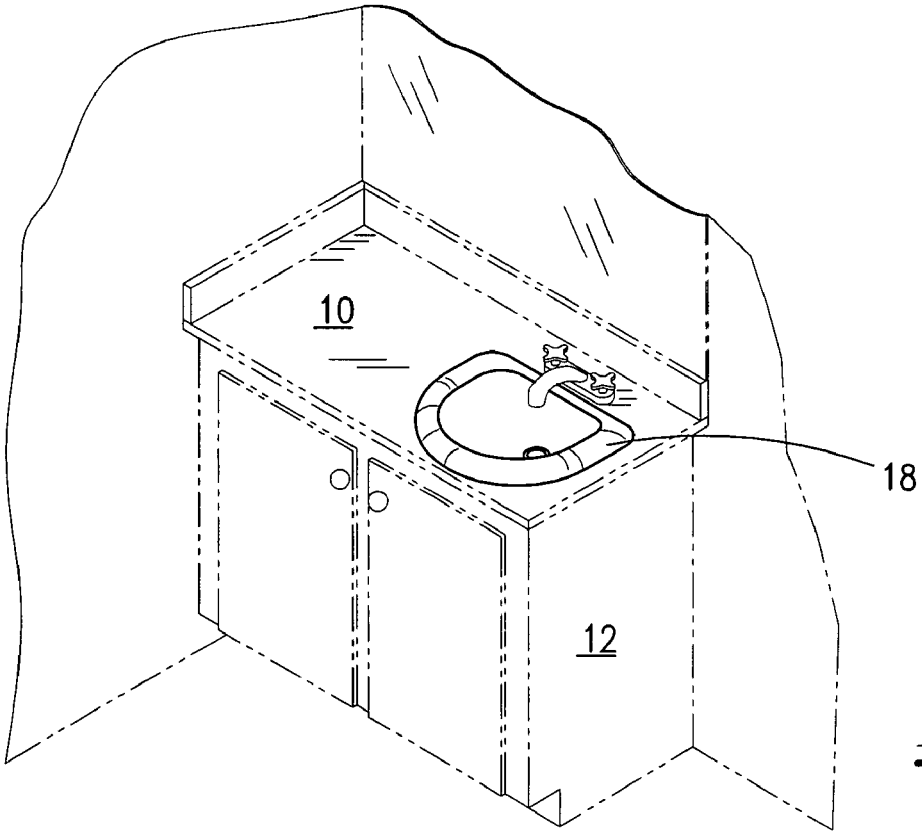
FIG. 3 is a partial isometric view of the preferred embodiment of a sink insert installed over the existing sink portion of the countertop shown in FIG. 1.

In any case, restoration of cultured marble countertops in some cases may include the necessity for installing a permanent sink overlay as opposed to disposable sink liners or temporary sink inserts. In this case the overlay is achieved by overlaying a new sink 18 over the existing sink 16 without disturbing the existing plumbing, as shown in FIG. 3.

Figure 4:
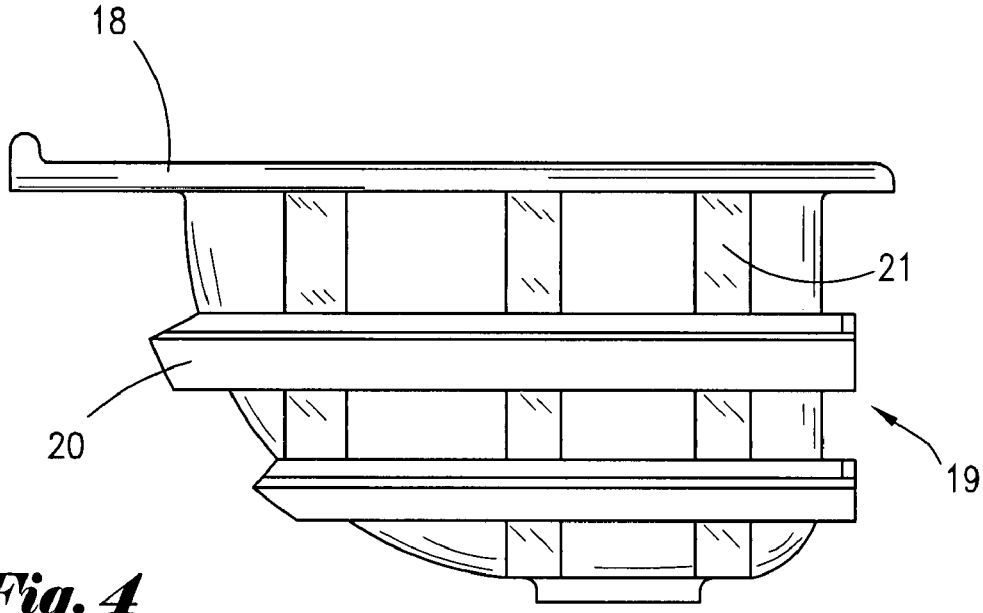
FIG. 4 is a vertical side view of the sink insert with foam grid.
Figure 5:
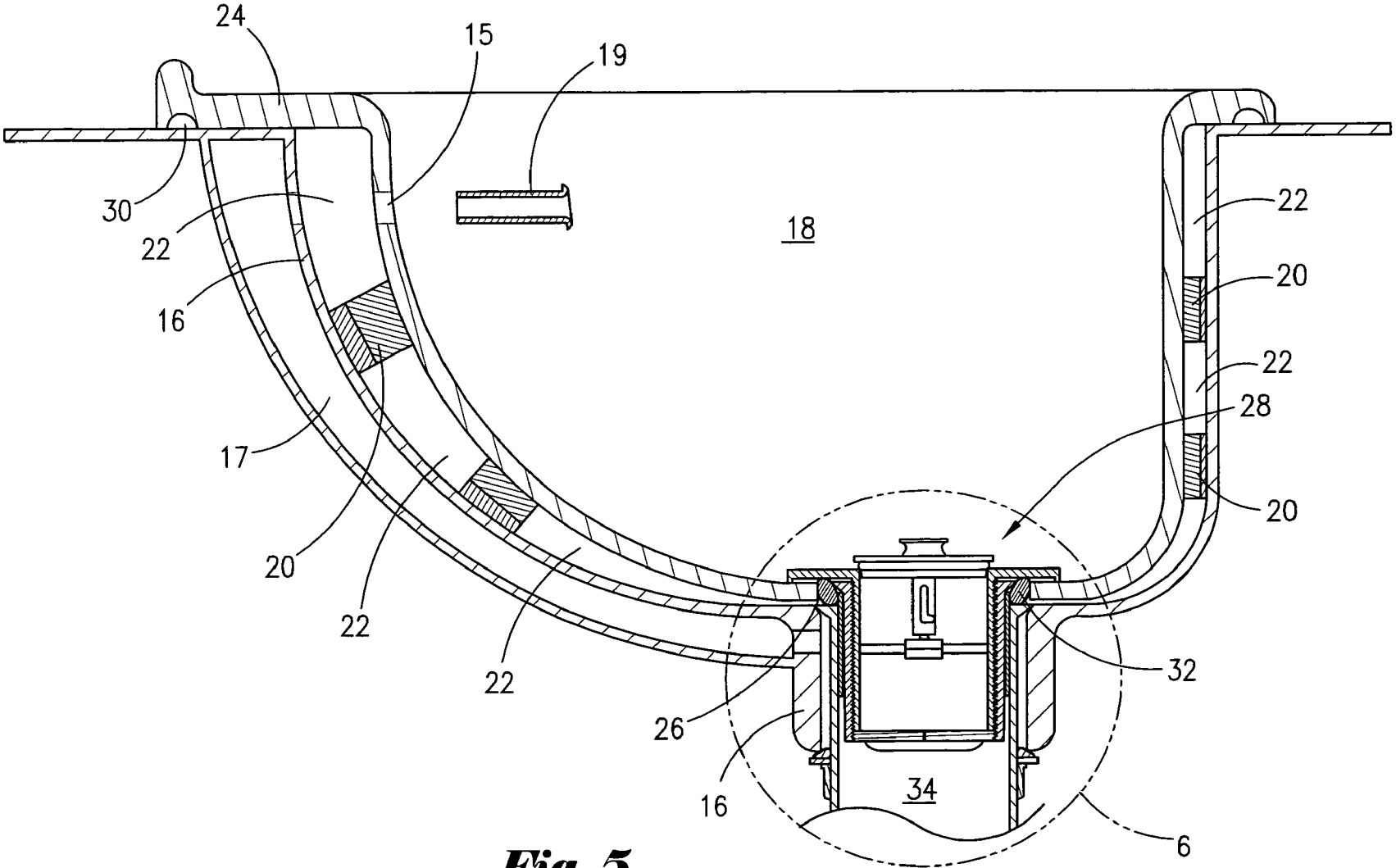
FIG. 5 is a cross section view of the sink insert as installed over and within an existing cultured marble countertop/sink with interlocking drain assembly.

Since a large number of manufacturers produce one-piece cultured marble countertop/sink combinations for the construction market, they seldom have the exact same sink shape or dimensions. However, it has been found that by averaging the sink dimensions of the most commonly manufactured cultured marble countertop/sinks, a relatively small number of shapes having a common set of dimensions can be premolded that will fit within a wide range of countertop/sink applications. However, to insure a tight fit, a grid 19 having vertical and horizontal rows composed of one or more layers of varying thicknesses of adhesive-backed foam or mastic strips 20,21 is applied to the external surface of the sink overlays or inserts 18 prior to installation, as shown in FIG. 4. Each layer of the mastic or foam strips 20,21 utilizes a peel off backing so that the sink insert 18 may be fitted within the existing sink 16 prior to exposing the adhesive and thereby allowing excessive thicknesses to be easily removed as necessary to insure the optimum fit. Once a good fit is achieved, the adhesive backings of the remaining foam strips 20, 21 may be removed and the sink insert or overlay 18 pressed into place within the existing sink 16, as shown in FIG. 5.

The pre-molded permanent sink insert 18 may be fabricated from any suitable formable material, which may include molded ceramic, a polymeric or even metal. Most replaceable drop in counter top sinks are usually a solid color. However, in this case, current molding techniques allow colorations that most closely identify with the cultured marble countertop/sink being restored.

Since the pre-molded permanent sink insert 18 is not an exact match for the cultured marble countertop sink being restored, spaces 22 may be present between the sink insert 18 and the existing sink 16. These spaces and the relatively wide upper horizontal eccentric flange 24, which is wider at the front than at the rear, allow the sink insert 18 to be positioned so that the drain opening 26 is in alignment with the existing drain opening. Any obstructions, such as drain plugs, filters, etc. should be removed. In most cases, this is a simple process of disconnecting the popup drain-connecting link.

The sink insert 18 is secured in place within the existing sink 16 being restored by a swage type expandable drain insert/seal assembly 28, thereby preventing separation.

A sealing material is applied under the horizontal flange 24 within the groove 30 to prevent the intrusion of water into the open spaces or cavities 22 located between the foam strips of the grid 19. A sealing compound 32 is also provided between the sink drain opening 26 and the drain insert/seal assembly 28. However, any leakage that occurs between the sink insert 18 and the existing sink 16 will eventually seep into the existing drain line 34. Orifices may also be provided within the drain insert/seal assembly 28 to accommodate overflow channels 17 provided in some existing sinks, as shown in FIG. 5. In such cases, the sink insert 18 may be drilled to provide porting leading to the existing integral overflow drain channel 17. A tubular insert 19 may be used to connect the port 15 to the overflow channel 17.

Figure 6:
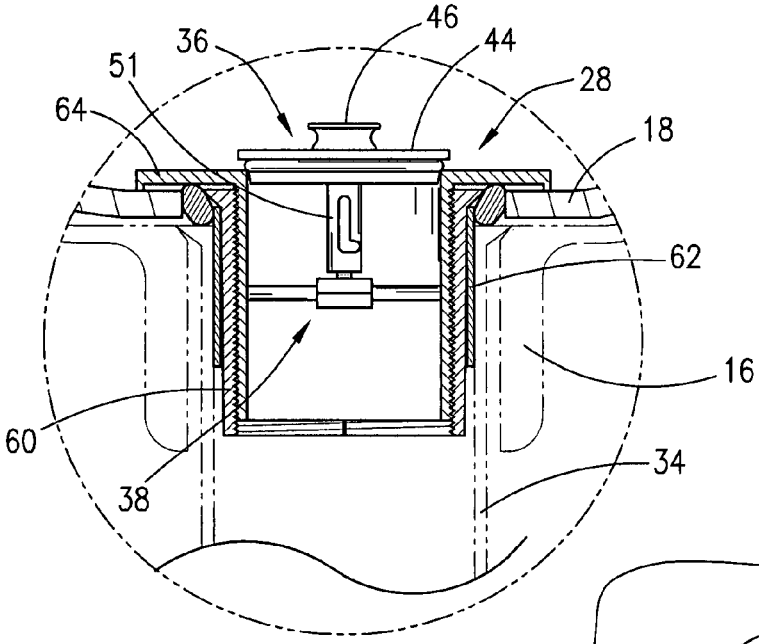
FIG. 6 is cross section view of the interlocking drain assembly as installed in the sink insert and existing drain in the plugged position.
Figure 7:
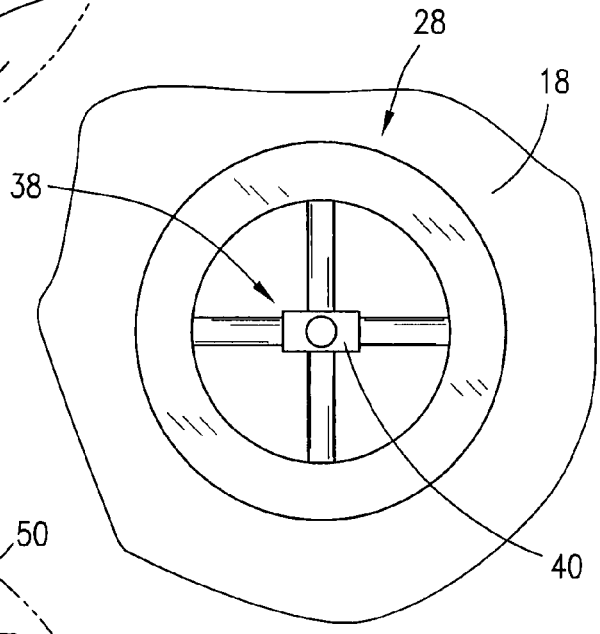
FIG. 7 is a top view of the interlocking drain assembly with the plug removed.
Figure 8:
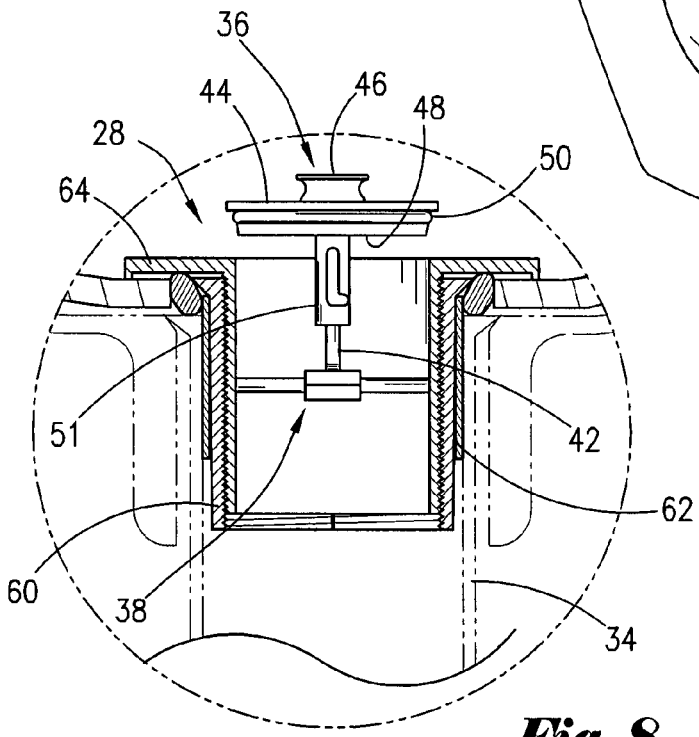
FIG. 8 is cross section view of the interlocking drain assembly as installed in the sink insert and existing drain in the plugged position.

The drain insert/seal assembly 28, seen in more detail in FIGS. 6, 7 and 8, demonstrates a simplistic approach to securing the insert sink 18 to the existing drain line 34 by utilizing an stem sleeve 51 and o-ring 50 for the drain insert/seal assembly 28. Further, although a variety of drain plug arrangements may be used in combination with the drain insert/seal assembly 28; one such arrangement is shown here as plug assembly 36. The plug assembly 36 includes a cross bar assembly 38 having a central internal threaded member 40 located within the drain insert/seal assembly 28, arranged as shown in FIG. 7 also used as a means for gripping by the insertion tool 66 to rotate the drain flange 64. A stem member 42, threaded at one end, is threaded into the central internal threaded member 40. A stopper or plug member 44 is provided having an upper knob portion 46, a sealing portion 48, including a stem sleeve 51 located opposite the knob portion 46 containing an o-ring 50. The sleeve 51 having a channel and or a spring cooperative with a lug (not shown) is located on the stem 42 in a manner which allows the stopper or plug member 44 to be rotated and depressed, as seen in FIG. 6, or rotated into a raised and locked position, as shown in FIG. 8.

Figure 9:
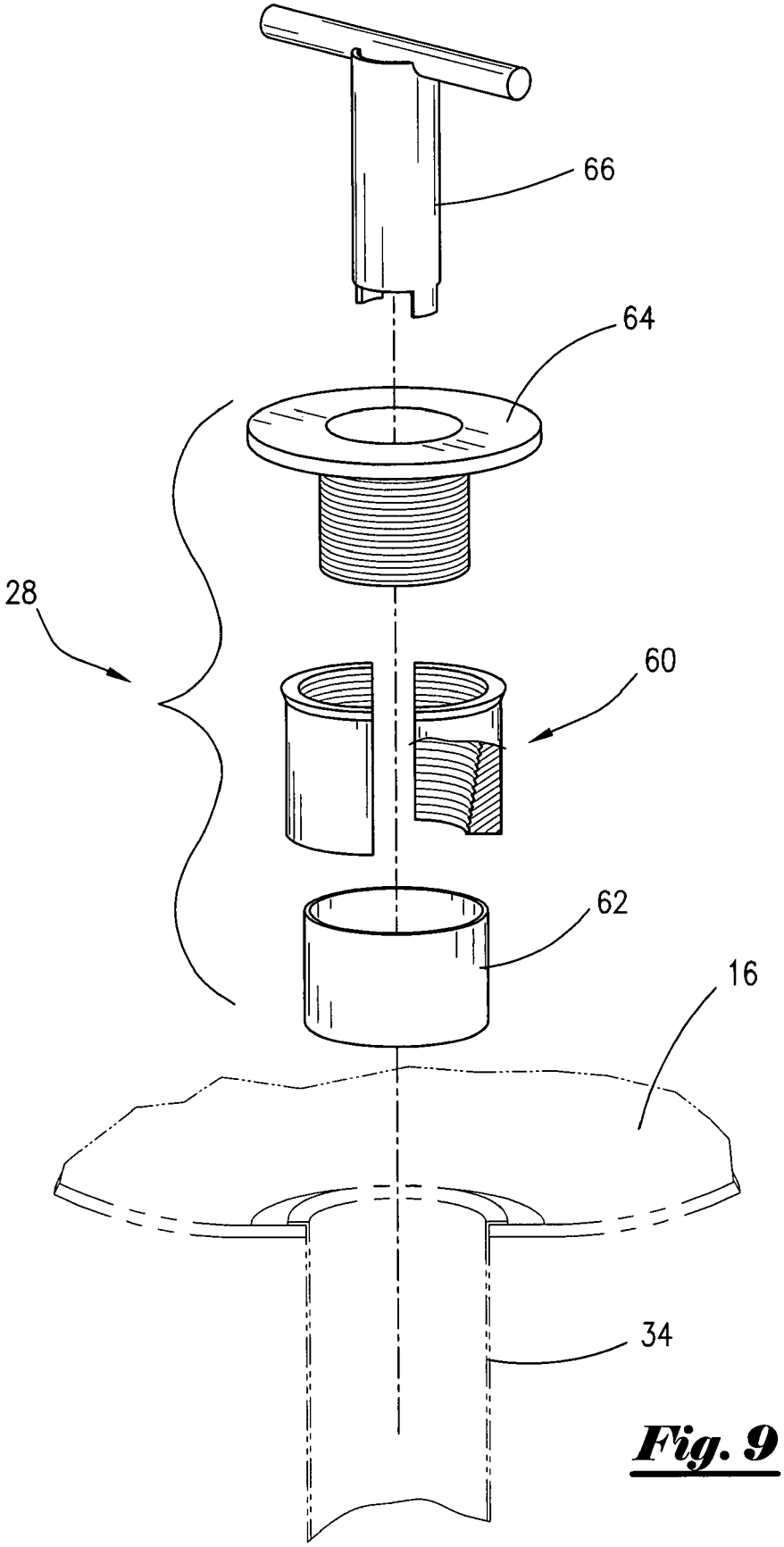
FIG. 9 is an isometric view of the interlocking drain assembly and installation tool.

As may be seen in FIG. 9, the drain insert/seal assembly 28 includes a tapered split sleeve 60 having internal threads, retained by an elastic band 62, and an externally threaded drain flange member 64. In most cases, the cross bar assembly 38, shown in FIG. 7, or a similar element is installed within the throat of the flange member 64 thus providing a means for turning the flange member 64 relative to the split sleeve 60. With the threads of the flange member 64 engaging the internal threads of the two halves of the split sleeve 60, rotation of the flanged member 64 with the tool 66 expands the sleeve and elastic or polymeric band 62. When the drain insert/seal assembly 28 is inserted within an existing drain 34, expansion of the sleeve forms a sealed connection to the existing drain line 34 and firmly secures the sink insert 18 in close proximity to the existing sink 16.

In some cases restoration of cultured marble countertop/sinks may only require minor work to enhance the appearance of the sink portion 16. In some cases, where only the sink drain is corroded or there are stains on the cultured marble around the drain, it may be possible to simply cover the stains and corroded drain fitting with the drain insert/seal assembly 28 without the need to install a sink insert. In such cases the insert/seal assembly 28, having a larger flange than the existing sink drain, is simply inserted into the existing drain fitting and expanded forming a secure seal without disturbing the original plumbing and thus covering the stains or corrosion damage and thereby improving the esthetics of the existing sink.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An expandable drain insert assembly comprising:

a) an externally threaded tubular member having a flange portion at one end;

b) a tapered split sleeve having internal threads, said threads cooperative with threads of the externally threaded tubular member;

c) an elastic band surrounding the split sleeve; and d) a means located within the externally threaded tubular member for gripping and rotating the externally threaded tubular member relative to the tapered split sleeve.

2. The expandable drain insert according to claim 1 wherein the split sleeve comprises an elongated tubular having two tapered halves that expand upon threadable engagement with the externally threaded tubular member.

3. The expandable drain insert according to claim 1 wherein the elastic band is a polymeric sealing member.

4. The expandable drain insert according to claim 1 wherein the means located within the externally threaded tubular member is a cross bar assembly.

5. The expandable drain insert according to claim 4 further comprises a plug assembly attached to said cross bar assembly.

6. The expandable drain insert according to claim 5 wherein said plug assembly further comprises a plug member having an upper knob portion, sealing portion and a stem sleeve.

7. The expandable drain insert according to claim 1 further comprises a tool cooperative with the means located within the externally threaded tubular member for gripping and rotating the externally threaded tubular member.

8. An expandable drain insert assembly comprising:

a) an externally threaded tubular member having a flange portion at one end;

b) a tapered split sleeve having internal threads, said threads cooperative with threads of the externally threaded tubular member;

c) an elastic band surrounding the split sleeve; and d) a plug assembly attached to a cross bar assembly located within said flange portion.

* * * * *